US005102034A

United States Patent [19]

Amabili

[11] Patent Number: 5,102,034

[45] Date of Patent: Apr. 7, 1992

[54] EGG CONTAINER

[76] Inventor: Arnaldo Amabili, 7680 Dollier Street, St. Leonard, Quebec, Canada

[21] Appl. No.: 596,699

[22] Filed: Apr. 4, 1984

Related U.S. Application Data

[63] Continuation-in-part of Ser. No. 360,591, Mar. 22, 1982.

[51] Int. Cl.[5] ..... B65D 1/24

[52] U.S. Cl. ..... 229/2.5 EC; 220/508

[58] Field of Search ..... 229/2.5 EC; 206/45.19; 220/508

[56] References Cited

U.S. PATENT DOCUMENTS

| | | | |
|---|---|---|---|
| 1,930,896 | 10/1933 | Hause et al. | 206/45.19 |
| 1,961,294 | 6/1934 | Hassell | 206/45.19 |
| 3,392,902 | 7/1968 | Donovan | 229/2.5 EC |
| 3,570,747 | 3/1971 | McKenna | 229/2.5 EC |
| 3,643,857 | 2/1972 | Noguchi | 229/2.5 EC |
| 3,670,952 | 6/1972 | Venoti et al. | 229/2.5 EC |
| 3,682,597 | 8/1972 | Husch | 206/45.19 |
| 4,057,188 | 11/1977 | Steinhardt | 229/2.5 EC |
| 4,088,259 | 5/1978 | Sutton | 229/2.5 EC |
| 4,090,658 | 5/1978 | Fukuda | 229/2.5 EC |
| 4,193,531 | 3/1980 | Saby | 229/2.5 EC |
| 4,194,682 | 3/1980 | Congleton et al. | 229/2.5 EC |
| 4,394,214 | 7/1983 | Bixler et al. | 229/2.5 EC |
| 4,462,537 | 7/1984 | Grootherder et al. | 229/2.5 EC |

FOREIGN PATENT DOCUMENTS

| | | | |
|---|---|---|---|
| 1120882 | 7/1968 | Fed. Rep. of Germany | 229/2.5 EC |
| 191685 | 5/1954 | Sweden | 229/2.5 EC |

*Primary Examiner*—Joseph Man-Fu Moy
*Attorney, Agent, or Firm*—Robert J. Schaap; Eric Fincham

[57] ABSTRACT

The invention discloses a container for fragile objects such as eggs, the container comprising upper and lower sections with the lower section having a plurality of individual cells, each cell having gripping means therein to hold and securely retain a single commodity such as a single egg.

25 Claims, 4 Drawing Sheets

29
29
27
28
28
10
30
27
30
9
9
30
28
7
6
6
5
5
8
10
10
7
8
36
106
110

EGG CONTAINER

This application is a continuation-in-part of co-pending application Ser. No. 360,591 filed Mar. 22, 1982.

The present invention relates to a container and more particularly, relates to a container for fragile objects such as eggs. Many containers are known in the art and in the particular field relating to eggs, conventionally egg containers have consisted of upper and lower sections hingedly connected together with the lower section having a plurality of egg cells formed therein. The container is usually manufactured of a paper mache or a foam material. Each size of egg generally has its own container although the eggs are not adapted to fit snugly within an egg cell since within each size category, a certain variation does occur. Accordingly, the eggs are normally free to move within the egg cell to a certain extent and little or no cushioning is achieved apart from that afforded by the inherent properties of the material. As is well known, the normal handling of eggs permits a substantial breakage to occur which, in the retail market, is both expensive and an inconvenience to the consumer.

As aforementioned, in the commercial market, the containers are formed of a single material—a pulp material or a foam material. While the foam material has been found to present a more attractive package to the consumer since the graphics are better, the insulation properties of the foam material have sometimes been cited as disadvantageous. The pulp material does not afford the high quality graphics achievable with the foam material.

It has been proposed in the prior art to provide means for cushioning the eggs and thus, one may find various proposals for pads and the like. However, since the eggs are still free to move within the egg cell, breakage can still occur.

It is an object of the present invention to provide a container for a fragile product wherein the product is securely held and retained in a fixed position.

It is a further object of the present invention to provide a container suitable for eggs wherein a single size egg cell may be utilized to receive several different sizes of eggs while still securely holding and retaining each egg in a fixed position.

It is a further object of the present invention to provide an egg container wherein visual inspection of the contents may be had while an esthetically attractive exterior appearance is achieved through the utilization and combination of different materials.

According to the present invention, there is provided a container for fragile products wherein the container includes a plurality of product-receiving cells formed therein. The product receiving cells are each adapted to receive a single product and each cell is separated from adjacent cells. Each cell has a plurality of product gripping means therein which are adapted to grip and retain each product in a secure fixed relationship. Each cell can adapt to "normal" variations in product size.

In one particular aspect of the invention, there is provided an egg container which includes upper and lower sections, the lower section having a plurality of egg receiving cells, each egg receiving cell being separated from every other egg receiving cell. Each cell is characterized by having a plurality of egg gripping means, which egg gripping means flex outwardly in response to the insertion of an egg in the cell and which egg gripping means are adapted to hold and retain the egg in a fixed position which is spaced from the bottom of the container. The upper section may include inwardly projecting means disposed over each cell to engage an upwardly presented tip portion of an egg in each cell. Means are provided for securing the upper and lower sections together.

In a further aspect of the invention, there is provided an egg container which comprises upper and lower sections. The lower section is formed of two components—the first being a tray member formed of a plastics material and having a plurality of spaced-apart egg cells each adapted to receive a single egg. Each egg cell has means to grip and retain the egg in the cell. The tray also includes a side wall which is spaced from any of the egg cells and which side wall extends the full height or depth of the tray. The second component of the bottom section is a reinforcing paperboard or cardboard member extending about the bottom of the tray member and being secured to the side walls of the plastic tray. The cardboard or paperboard member acts as a reinforcement and the two members together provide a substantially rigid lower section. An upper section, which is preferably transparent, may be locked or secured to the lower sections through co-operating locking means on both upper and lower sections.

In the present invention, reference will be made to a container suitable for the packaging of eggs. However, the container and/or certain elements thereof may be utilized for packaging other products as will become apparent from the description hereinbelow.

The lower section, as previously mentioned, includes a plurality of egg cells therein with each cell having a plurality of egg gripping sections. Each egg gripping section is formed of a generally arcuately shaped convex portion which is at least partially deformable outwardly in response to the force of an egg being placed in the cell. The egg gripping sections are designed to grip and retain an egg in a fixed position rather than merely cushioning the egg as is known in the prior art. Thus, the egg gripping sections retain the egg in a single fixed position despite movement of the container. Each egg gripping section, in order to accomplish the above, is formed substantially vertical or parallel to the exterior surface of the egg to be placed in the cell. Thus, while the arcuate section may taper slightly, it is necessary that it not taper to too great a degree or it will not be able to retain the egg in a fixed position. Furthermore, each egg gripping section is placed so as to contact the egg at a position so as to retain the egg as aforementioned. To accomplish this, the egg gripping section will extend to between 40–70% of the height of an egg with a preferred height of the egg gripping sections being between 50–60% of the egg height.

In order to provide the deformable egg gripping sections, the cells are preferably formed of a plastics material which is deformable outwardly. Many suitable plastic materials are known to those knowledgeable in the art.

The lower section of the egg container of the present invention is preferably formed of two components—a tray member of a plastics material having a plurality of of egg cells therein and a reinforcing member. The tray member itself does not have sufficient inherent strength to withstand the handling to which it is subjected. Furthermore, it is desirable that the plastics material be relatively thin and accordingly, there is not sufficient rigidity in the plastic tray. To overcome this problem, it is preferred that a cardboard or paperboard material be utilized in conjunction with the plastic tray section. The plastic tray member will preferably include a downwardly depending exterior wall spaced from the walls defining the egg cells. The cardboard or paperboard member is then adhesively or otherwise secured to the exterior wall of the plastics tray member and also forms a bottom for the latter section. It has been found that the marriage of the two materials provides a substantially rigid bottom section which also affords excellent protection to the eggs while use of the cardboard or paperboard member permits excellent graphics.

The upper section of the egg container is preferably formed of a clear plastics material such that visual inspection of the contents of the container may be had. Also, the upper section will preferably include means for securing the same to the lower section such as cooperating locking means. In a retail container, the upper section may include a plurality of cushioning means associated therewith for cushioning the top portion of an egg placed in an egg cell.

Having thus generally described the invention reference will be made to the accompanying drawings illustrating embodiments thereof, in which:

FIG. 11 is a sectional view, somewhat similar to FIG. 5, but showing an egg in phantom view in an egg cell forming part of the package of the present invention.

In greater detail, the egg package of the present invention includes an upper section comprised of cover C and a lower section comprised of tray component T and base component B.

Tray component T consists of a plurality of egg cells, each adapted to contain a single egg. In the embodiment illustrated, the package consists of two half-sections, each having six egg cells therein.

Figure 2:
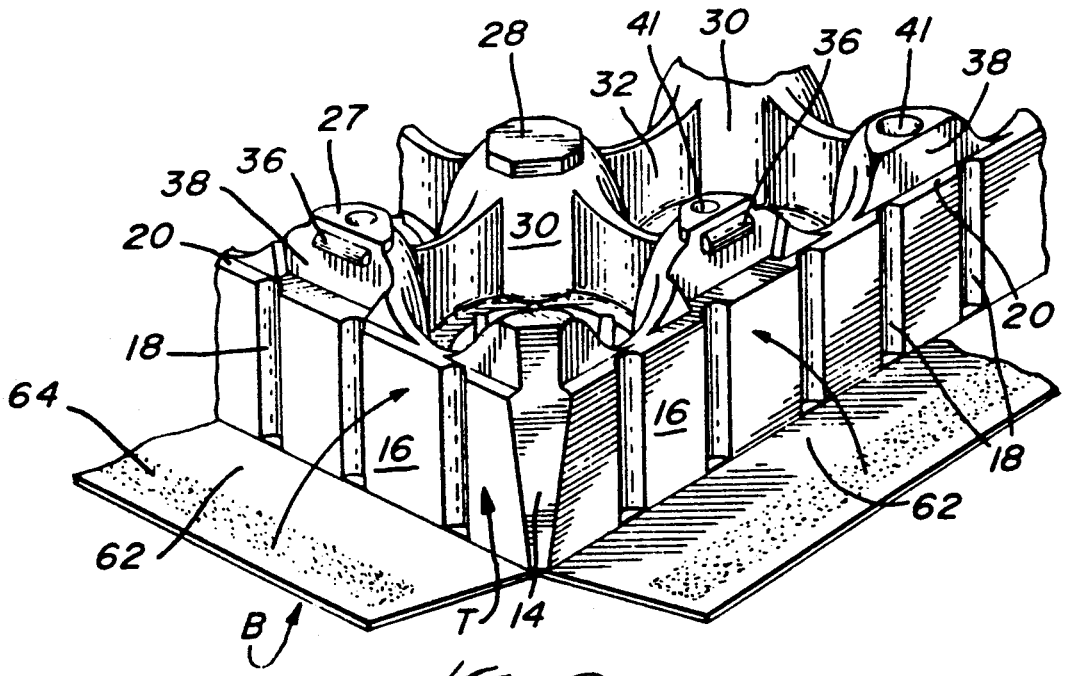
FIG. 2 is a perspective view of a portion of the tray of the egg package of FIG. 1.
Figures 3, 4:
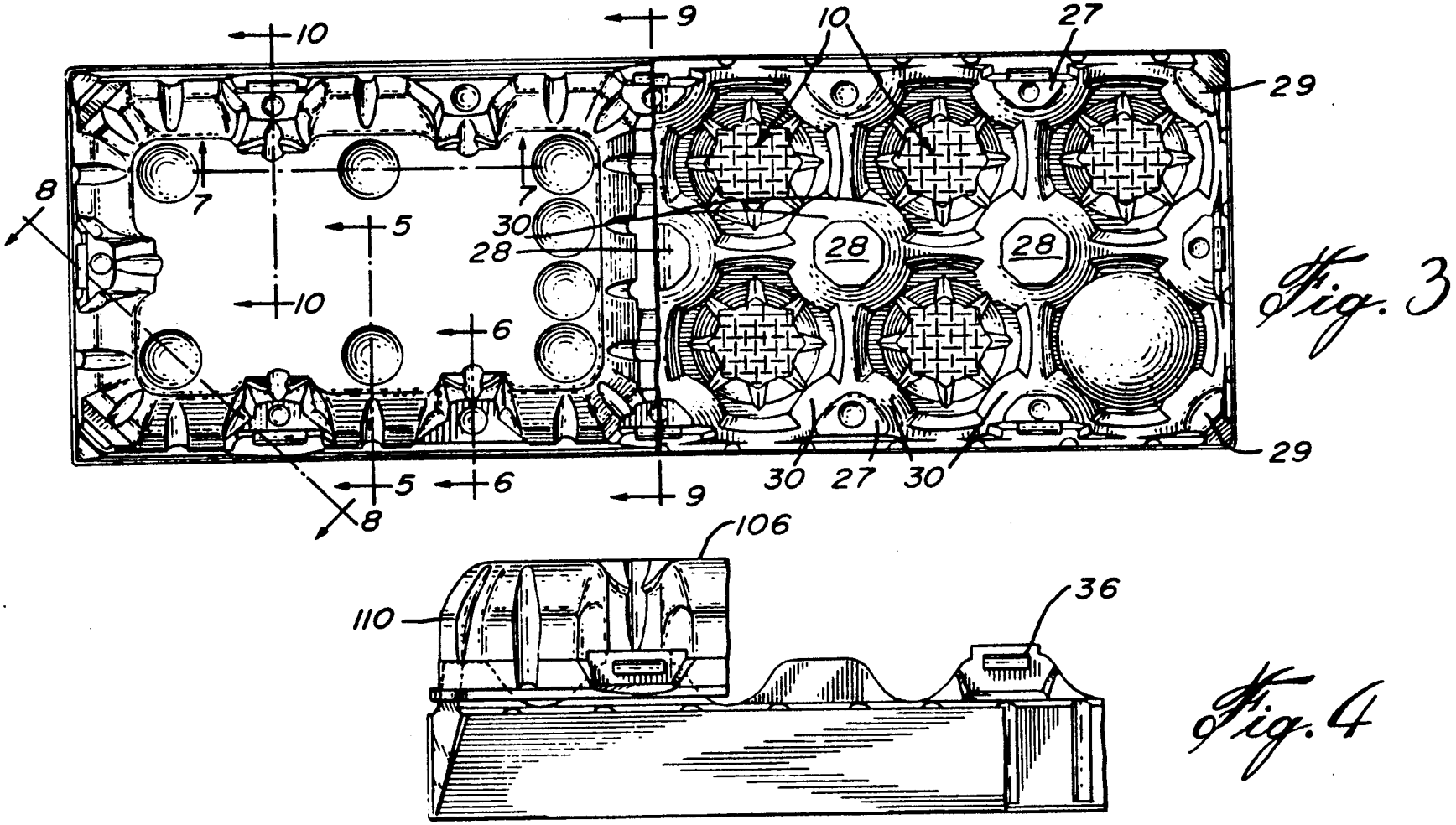
FIG. 3 is a plan view, with the cover removed on a portion thereof, of the package of FIG. 1.
FIG. 4 is an elevational view, partially cut away, of the package.

Tray T is of a generally rectangular configuration and has an outer side wall 16 having a plurality of inwardly extending ribs 18 formed therein to add rigidity to the wall. At the corners of the wall sections 16, an angled portion 14 is provided as shown in FIG. 2. Extending inwardly from the upper margin of side wall 16 is an upper horizontal wall portion generally designated by reference numeral 20 which assures that side wall 16 is spaced from each egg cell as will be apparent.

Tray section T as aforementioned, includes a plurality of egg cells generally designated by reference numeral 10. Each egg cell is partially defined by a generally circular lower cell wall 22 having a plurality of corrugations or flutes 24 therein. Extending along the lower margin of lower cell wall 22 is a bottom cell wall 26.

At the upper margin of lower side wall 22 is an intermediate horizontal wall section 34. Intermediate horizontal wall section 34 terminates in an upper cell side wall portion 32. Forming a portion of upper cell side wall 32 are a plurality of egg gripping sections generally designated by reference numeral 30. Each cell 10 has four of such egg-gripping sections 30, each of which section is adapted to flex outwardly when an egg is placed in such cell 10 and thereby retain the egg in its desired position.

Each section 30 terminates in at least a partial dome portion. In this respect, in the center of tray T there are provided five full dome portions 28, each of which has four egg-gripping sections 30 extending therefrom. Similarly, there are provided twelve half-dome sections 27 which have two egg-gripping sections 30 extending therefrom and at the four corners of the container, there are provided quarter-dome sections 29 each having a single egg gripping section 30 extending therefrom.

Upper horizontal wall section 20 terminates at an upper outer wall generally designated by reference numeral 38. As may be seen from FIG. 2, half-dome portions 28 are formed in two different alternating configurations. In a first configuration, horizontal wall section 20 extends inwardly a slightly greater distance than usual and upper outer wall 38 has a projection 36 extending outwardly therefrom. Projection or nose 36 has an arcuate upper surface 37 and a lower substantially horizontal surface 39. In the alternate configuration, horizontal wall section 20 does not extend inwardly to the same extent as that previously described and upper outer wall 38 merely terminates at the drop of half-dome 27 without any projection thereon.

Each half-dome section 27 includes a recess 41 therein, which recess forms a portion of the locking means as will be discussed hereinbelow. As will be seen from FIG. 2, the half dome 27 formed at either of the ends of the tray T have projection 36 formed on upper outer wall 38.

Base component B, which may be made of a suitable paperboard or cardboard material, comprises a bottom 60 and walls 62 adapted, by means of glue 64, to adhere to outer side walls 16.

Cover C in the embodiment illustrated is divided into two half-sections 100 and 102, each section being substantially identical and being joined by an intermediate section 104.

Cover C includes an upper horizontal top wall 106 having, at a location corresponding to the top of each egg cell 10, a dimple or egg-cushioning means generally designated by reference numeral 108. In addition, two additional dimples 108 are provided adjacent intermediate section 104. Extending downwardly in an arcuate manner as will be described in greater detail, is cover side wall 110. Cover side wall 110, as may be noted from FIGS. 5, 6 and 8 through 10, extends outwardly and downwardly adjacent cushioning means 108 at a different angle than where recesses 41 are provided. Adjacent recesses 41, cover side wall 110 extends substantially downwardly and terminates in an outwardly extending horizontal portion generally designated by reference numeral 112.

Formed within horizontal section 112 is a male projection 115 adapted to seat in recess 41. Also, in those portions of cover side wall 110 corresponding to where projections 36 are located, there is provided an outwardly extending flange portion 116 and subsequent undercut 114 which is adapted to receive projection 36 and thus provide a locking means for the cover to the tray.

Figure 1:
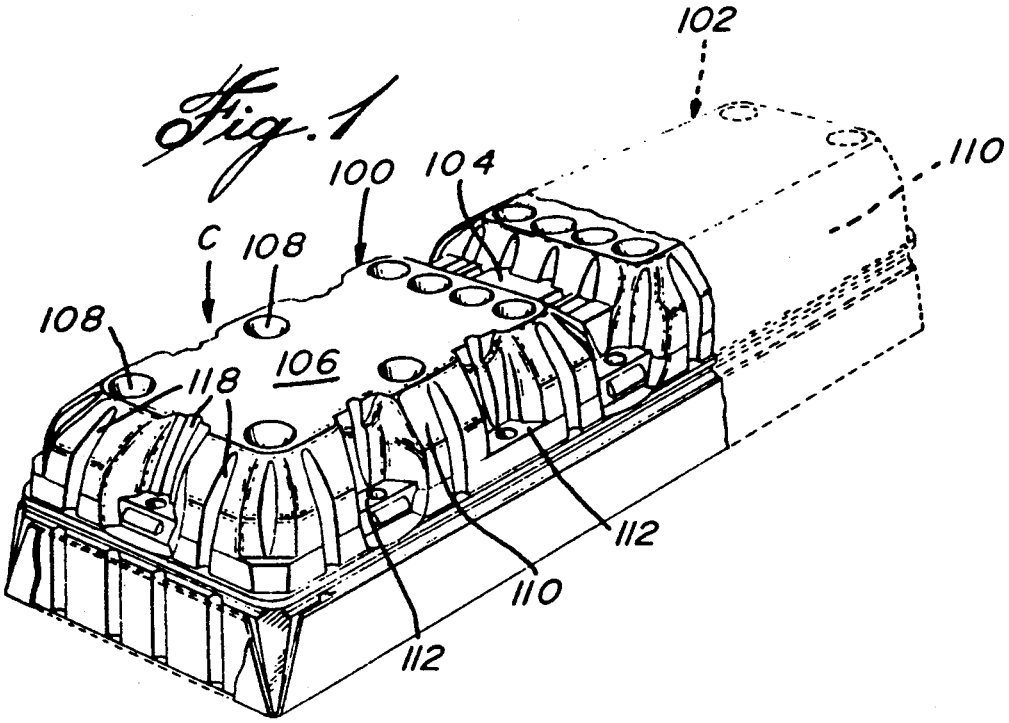
FIG. 1 is a perspective view of an egg package of the present invention.
Figure 9:
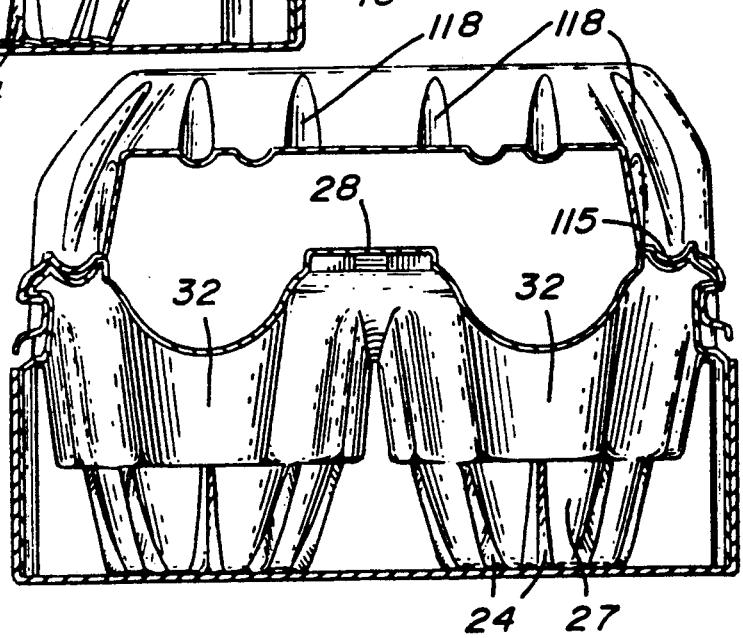
FIG. 9 is a sectional view along the lines of 9—9 of FIG. 3.
Figure 10:
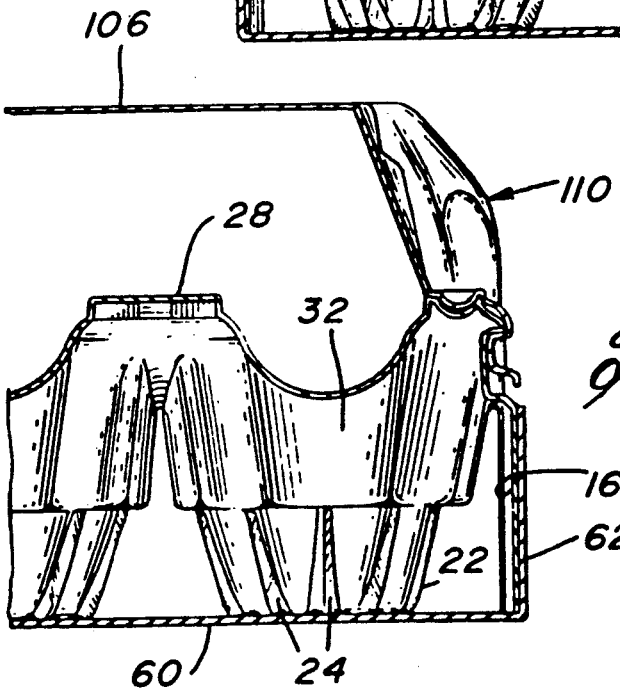
FIG. 10 is a sectional view along the lines of 10—10 of FIG. 3.

Cover side wall 110 includes a plurality of inwardly extending corrugations or flutes 118 which add rigidity to the cover structure. In addition, corrugations or flutes 118 are provided in intermediate section 104 as seen in FIG. 1 and 9.

Both the tray and cover are preferably made of a suitable plastic material having the desired flexibility for proper functioning of the container. Preferably, the cover is made of a transparent material such that visual inspection of the eggs may be had.

In packaging the eggs, each egg is placed in a cell 10 and a gentle downward pressure may be exerted thereon. This causes egg-gripping sections 30 to flex outwardly with respect to the center of a cell while exerting a pressure on the eggs. In this respect, it will be noted that egg-gripping sections 30 are arcuate in nature in both directions—i.e. from the top of dome section 28, they curve inwardly down to lower cell wall 22. This permits the eggs to be securely held and the container may be turned upside down without the eggs falling out. The container is sized such that the eggs do not touch bottom cell wall 26. Preferably, the placement of the egg is such that between 50–60% of the height of the egg is below the point of first contact of egg gripping section 30 with the egg.

Following placement of the egg in the cell 10, cover C is placed on top. The cover is sized such that dimples 108 are adapted to just touch the top of an egg placed in an egg cell 10. Dimples 108 will act as a cushioning means for the eggs due to the flexible nature of the plastic material forming cover C. As may be seen from the figures, the mating of projections 36 with flange 116 and undercut 114 forms a locking means to retain the cover on the tray. In addition, the mating of recesses 41 and male projection 115 prevent the side walls 110 from flexing outwardly when a pressure is put on top 106.

It has been found that the egg container of the present invention may be adapted to hold several different sizes of eggs in a single size container. Due to the nature of egg-gripping sections 30 and the design of the container, the single size container may serve to package and hold securely both small and medium (and in some instances large) eggs.

Figure 5:
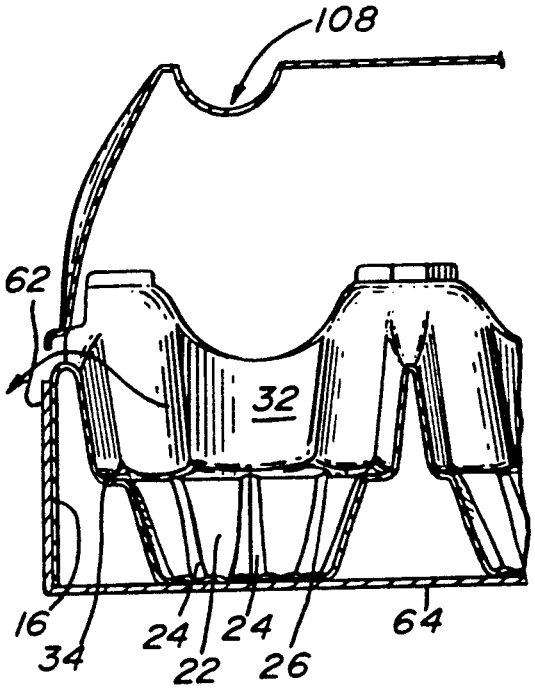
FIG. 5 is a sectional view taken along the lines 5—5 of FIG. 3.
Figure 6:
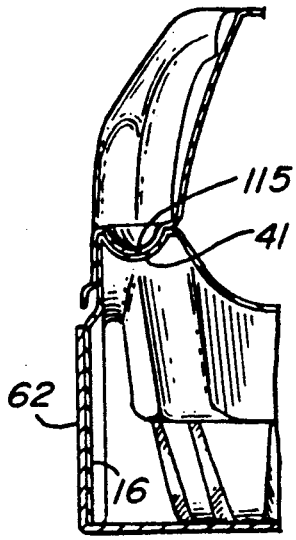
FIG. 6 is a sectional view along the lines 6—6 of FIG. 3.
Figure 7:
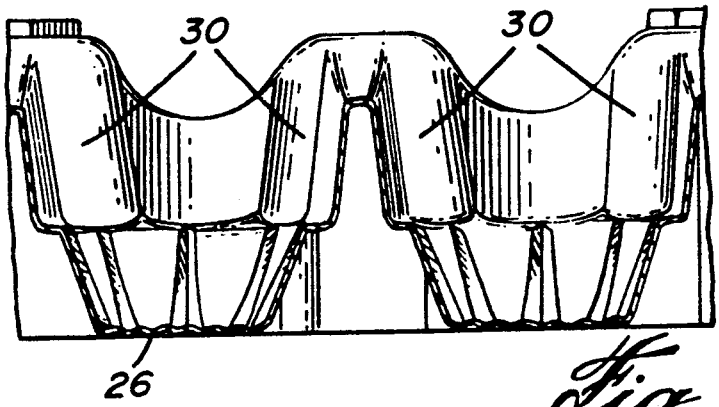
FIG. 7 is a sectional view along the lines 7—7 of FIG. 3.
Figure 8:
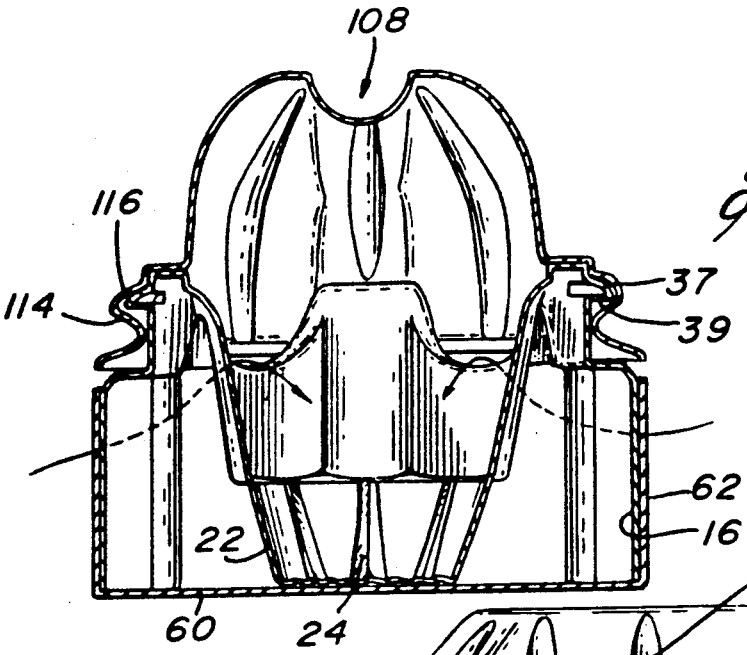
FIG. 8 is a sectional view along the lines of 8—8 of FIG. 3.

As may be seen from FIGS. 5 and 8, side wall 110 adjacent each egg cell 10 terminates short of horizontal wall section 20 to thereby leave an air gap therebetween. This permits the circulation of air to reach the eggs in the egg cells.

As previously mentioned, each egg gripping section 30 should be substantially vertical and of a sufficient height such that the egg may be held and retained in a desired position. Once inserted into the cell, the egg is not capable of freely moving and is "suspended" in a desired position. It is to be noted that the egg does not touch the bottom 60 of base component B and is also spaced from the side walls of the tray and therefore walls 62 of component B. Accordingly, accidental knocks and movement will not break the eggs in the egg cells.

The container presents a number of advantages as previously mentioned. It is through the combination of material that a lightweight yet rigid structure is achieved.

It will also be understood that although the above-described embodiment relates to eggs, the package may equally well be utilized for other fragile objects or products which need protection. Thus, the tray portion may be utilized for packaging fruits such as tomatoes and the like wherein protection for the product is desirable. It will also be understood that the above-described embodiment is for purposes of illustration only and that changes and modifications may be made thereto without departing from the spirit and scope of the invention.

I claim:

1. An egg container comprising: a base tray including a plurality of egg cells each of which is adapted to receive a single egg, each of said cells having a wall extending thereabout to define the cells, said wall of each cell including a plurality of egg-gripping sections extending inwardly toward the interior of the cell, each of said egg gripping sections being generally convex toward the interior of a cell and arcuately shaped in two different mutually perpendicular planes, each egg-gripping section flexing in response to the pressure of an egg inserted into a cell such that it is partially deformable outwardly by an egg in response to the force of the egg being placed in the cell in a position wherein the tip portions of the egg are disposed upwardly and downwardly such that each of the gripping sections of a cell exerts a retaining force on the egg, and locking means adapted to secure the cover to the tray;

said cover including a top wall portion and a side wall portion, said top wall portion having a plurality of inwardly projecting egg cushioning means therein with a separate inwardly projecting means disposed over each such cell, each inwardly projecting means being adapted to engage the upwardly presented tip portion to restrain an egg in such cell against vertical movement, said side wall portion having locking means thereon to co-operate with the locking means on the tray.

2. The container of claim 1 wherein said tray is a one-piece unit formed of a plastic material.

3. The container of claim 1 wherein said cover is a one-piece unit formed of a transparent plastic material.

4. The container of claim 1 wherein said tray includes a plurality of recesses formed on a horizontal section thereof and said cover includes a plurality of male projections adapted to seat in said recesses.

5. The container of claim 4 wherein said locking means includes a projection on a side wall of said tray and a recess formed in said cover side wall to receive said projection.

6. An egg container comprising a tray and a cover, said tray comprising a plurality of egg-receiving cells, each egg-receiving cell being separated from every other egg-receiving cell, said cover having inwardly projecting means for cushioning a top portion of an egg placed in each of said egg cells, each cell being comprised of an enclosing side wall and a bottom wall which extends thereacross and having a plurality of egg-gripping means therein, each egg-gripping means adapted to flex outwardly in response to the insertion of an egg in the cell in a position where the tip portions are disposed at the upper and lower ends of the eggs and to exert a pressure on said egg to retain the egg in the cell, said egg-gripping means also being arranged and sized so that the lower tip portion of an egg in each cell is spaced upwardly from the bottom wall of that cell and so that the upper tip portion of the egg is below the inwardly projecting means of the cover such that the egg is effectively suspended by the gripping means and that the gripping action to retain the egg being provided primarily by the egg-gripping means on said tray, said cover and tray having co-operating locking means to secure said cover to said tray, and said tray and cover providing air vent means therebetween.

7. The container of claim 6 wherein said tray is a one-piece unit formed of a plastic material.

8. The container of claim 7 wherein said cover is a one-piece unit formed of a transparent plastic material.

9. The container of claim 8 wherein said cell has four egg-gripping sections, each egg-gripping section extending arcuately inwardly towards said cell in two directions.

10. An egg container comprising:

a tray including a plurality of spaced apart egg cells and each of which is adapted to receive a single egg, each of said cells having an enclosing cell side wall extending thereabout and a bottom wall extending thereacross to define the cell, said side wall of each cell including a plurality of arcuately shaped egg-gripping sections extending inwardly toward the interior of the cell, each egg-gripping section being partially deformable outwardly by an egg in response to the force of an egg being placed in the cell in a position when the tip portions of the egg are disposed upwardly and downwardly, each of said egg gripping sections being substantially vertically arranged and extending upwardly to a height such that each of the gripping sections of a cell exerts an inwardly directed retaining force on the egg and retains the egg in a fixed position in a cell, said egg gripping means also being arranged and sized so that the lower tip portion of an egg in each cell is spaced upwardly from the bottom wall of that cell and that the gripping action to retain the egg being provided primarily by the egg-gripping means on said tray, an enclosing tray side wall extending around the periphery of said tray and having generally flat wall portions with vertically disposed reinforcing means formed in said generally flat wall portions, and locking means;

a cover including a cover top wall portion and a side wall portion, said top wall portion having a plurality of inwardly projecting egg cushioning means therein with a separate inwardly projecting relatively small diameter dimple shaped element disposed over each such cell, each inwardly projecting element being adapted to engage the upwardly presented tip portion to restrain an egg in such cell against vertical movement, said side wall portion having a locking means thereon to co-operate with the locking means on the tray, and a base associated with said tray and having a plurality of wall sections which engage said tray side wall and generally extend around the entire surface area of said tray side wall.

11. An egg container comprising a tray and a cover, said tray comprising a plurality of egg-receiving cells, each egg-receiving cell being separated from every other egg-receiving cell, each cell having a plurality of egg gripping means therein, each egg-gripping means comprising a convex wall section adapted to flex and exert a pressure on an egg placed in the cell, said convex wall section contacting the egg at a position about sixty percent of the total height of the egg to thereby securely retain the egg in the cell with substantially no movement thereof, locking means on said tray;

a cover including locking means thereon co-operating with the locking means on said tray, said tray and cover, when secured together providing vent means between the tray and cover permitting the passage of air into and out of the closed container.

12. The container of claim 11 wherein said tray includes an outer side wall extending thereabout, said outer side wall spaced from said egg-receiving cells, and a base member, said base member including a bottom and a plurality of flaps, said flaps being secured to said outer side wall to add rigidity to the container.

13. The container of claim 12 wherein said outer side walls extend downwardly substantially to the bottom of said base portion, and said locking means on said tray include a plurality of projections adapted to seat in a plurality of recesses formed on a side wall of said cover.

14. The container of claim 11 wherein said cover includes a top and downwardly depending side walls, said top having inwardly projecting means disposed over each egg cell for cushioning the top portion of an egg placed therein.

15. The container of claim 12 wherein the bottom of the egg in each cell is spaced upwardly from the bottom of said base.

16. An egg container comprising a tray and a cover, said tray comprising a plurality of egg-receiving cells, each egg-receiving cell being separated from each other egg-receiving cell, each cell having a plurality of egg-gripping means therein, adapted to flex in response to the insertion of an egg in the cell and to securely retain the egg therein, an outer side wall spaced from said egg-receiving cell, said outer side wall having a lower section and an upper section, said upper section being spaced inwardly of said lower section, a plurality of outwardly extending flanges on said upper wall section, said flanges extending a distance no greater than the inset of said upper wall, said cover including a top portion and downwardly extending side walls, said side walls having recesses therein adapted to receive said flanges of said tray to thereby securely lock the cover to said tray, said cover further including a plurality of projection extending from a horizontal surface formed in said side walls, said projections seating in recesses provided on a substantially horizontal tray surface.

17. The container of claim 16 further including a base member, said base member including a bottom wall and a plurality of flaps extending upwardly therefrom, said flaps being secured to the lower section of said tray outer side wall, the bottom of said lower side wall being proximate the bottom wall of said base member.

18. The container of claim 17 wherein the top of said cover includes a plurality of inwardly projecting means with a separate inwardly projecting means disposed over each cell and each adapted to engage an upwardly presented tip portion of an egg in such cell, the bottom of each egg being spaced upwardly from the bottom wall of said base member.

19. The container of claim 18 wherein said cover is formed of a transparent plastic material and said base member of a paperboard material, the upper section of the outer side wall of said tray being spaced inwardly providing a stop member to an adjacent tray when the trays are nested together such that each tray will be spaced from an adjacent tray.

20. An egg container comprising a tray, a cover and a base member, said tray comprising a plurality of egg-receiving cells, each egg-receiving cell being separated from every other egg-receiving cell and adapted to receive a single egg, each of said cells having a generally enclosing side wall extending thereabout to define the cell, the upper portion of said side wall including a plurality of egg-gripping means, each egg-gripping means comprising a convex wall section adapted to deform outwardly in response to the force of an egg being placed in the cell whereby each egg is securely retained in the cell solely by the action of the egg-gripping means with substantially no movement of the egg in the cell, an outer side wall on said tray which is spaced outwardly from each of said egg cells, said tray side wall being formed of a material and having a thickness which does not have sufficient rigidity to sufficiently support said container with eggs disposed in all of the cells thereof, locking means associated with said tray, said cover including a top and generally downwardly depending side walls, said top having inwardly projecting means disposed over each cell adapted to engage the upwardly presented tip portion of an egg in the cell, locking means associated with said cover adapted to co-operate with the locking means on the tray, said base member including a bottom wall and a plurality of flaps, said flaps being adhesively secured to said outer side wall of said tray and provide a rigidity to said tray side wall which enables the tray side wall to support the container with eggs in all of the cells thereof.

21. The container of claim 10 wherein said vertically arranged egg gripping sections extend upwardly in each cell to a height of about 40% to about 70% of the height of an egg in each such cell.

22. The container of claim 10 wherein said vertically arranged egg gripping sections extend upwardly in each cell to a height of about 50% to about 60% of the height of an egg in each such cell.

23. An egg container comprising:

a tray including a plurality of spaced apart egg cells and each of which is adapted to receive a single egg, each of said cells having a generally enclosing cell side wall including a plurality of arcuately shaped egg-gripping sections extending inwardly toward the interior of the cell, each egg-gripping section being partially deformable outwardly in response to the force of an egg being placed in the cell such that the gripping section exerts a retaining force on the egg, an enclosing tray side wall extending around the periphery of said tray and having generally flat wall portions with vertically disposed reinforcing means formed in said generally flat wall portions, said cover including a cover top wall portion and a cover side wall portion, said cover side wall portion being substantially non-engageable with an egg in a cell, said cover side wall portion having second and co-operating locking means thereon to co-operate with the first locking means on the tray; and a base associated with said tray and having a plurality of wall sections which extend upwardly for only a portion of the height of the tray side wall to engage a lower portion of said tray side wall and generally extend around the entire lower portion surface area of said tray side wall, said base being formed of a somewhat more rigid material than said tray to provide a reinforcing action, and first locking means on said tray adapted to secure the cover to the tray.

24. The container of claim 23 wherein said tray is a one-piece unit formed of a plastic material.

25. The container of claim 23 wherein said cover is a one-piece unit formed of a transparent plastic material.

* * * * *